US006158949A

United States Patent [19]

Walth et al.

[11] Patent Number: 6,158,949

[45] Date of Patent: Dec. 12, 2000

[54] BOOM ASSEMBLY OF A WORK MACHINE

[75] Inventors: Gary L. Walth, Cary; John P. Hall, Wilson; David H. True, Selma; Pushkar Tamhane, Raleigh, all of N.C.

[73] Assignee: Caterpillar Inc., Peoria, Ill.

[21] Appl. No.: 09/069,423

[22] Filed: Apr. 29, 1998

[51] Int. Cl.[7] ..... E02F 9/00

[52] U.S. Cl. ..... 414/722; 414/694; 29/891; 29/897.2

[58] Field of Search ..... 414/722, 694, 414/686; 403/52; 52/111, 116; 29/891, 897, 897.2, 897.31; 212/177

[56] References Cited

U.S. PATENT DOCUMENTS

| | | | |
|---|---|---|---|
| 1,973,950 | 9/1934 | Frank | 414/722 X |
| 3,057,494 | 10/1962 | Holopainen et al. | 414/694 |
| 3,698,569 | 10/1972 | Lamer et al. | 212/177 |
| 4,428,173 | 1/1984 | Knell | 212/347 X |
| 5,111,578 | 5/1992 | Ball et al. | 414/722 X |
| 5,152,659 | 10/1992 | Waka | 414/722 |

FOREIGN PATENT DOCUMENTS

| | | | |
|---|---|---|---|
| WO8802420 | 4/1988 | WIPO | E02F 3/38 |

OTHER PUBLICATIONS

Cover page of marketing brochure entitled "416B Backhoe Loader", from Caterpillar, Inc 1993.

*Primary Examiner*—Donald W. Underwood

*Attorney, Agent, or Firm*—Bradford G. Addison

[57] ABSTRACT

A work machine includes a boom body having a top boom support structure, a bottom boom support structure, a first lateral boom support structure, and a second lateral boom support structure which cooperate with each other to define a boom void therein. The boom body also has a machine frame coupling defined therein. The work machine also includes a coupling subassembly which is positioned within the boom void and attached to the boom body. The coupling subassembly includes (i) a first coupling support structure and a second coupling support structure which are spaced apart from each other so as to define a boss space therebetween and (ii) a boss positioned within the boss space and secured to the first coupling support structure and the second coupling support structure. In addition, (i) the boss has a pin passageway extending therethrough, (ii) the first coupling support structure has a first pin aperture defined therein, (iii) the second coupling support structure has a second pin aperture defined therein, and (iv) the pin passageway, the first pin aperture, and the second pin aperture are aligned with each other. The work machine further includes (i) a work machine stick which is pivotably coupled to the coupling subassembly and (ii) a work machine frame coupled to the machine frame coupling of the boom body.

6 Claims, 3 Drawing Sheets

BOOM ASSEMBLY OF A WORK MACHINE

TECHNICAL FIELD OF THE INVENTION

The present invention relates generally to a boom assembly of a work machine, and more particularly to a configuration a boom assembly of a work machine.

BACKGROUND OF THE INVENTION

Work machines may be used to move large amounts of material such as gravel. One type of work machine that is used for this purpose is a backhoe. During operation of such a work machine, a bucket is manipulated to gather a load of material at a first location. The bucket is then lifted and moved to a second location. Thereafter, the bucket is again manipulated to dump the material at the second location.

During lift, movement and manipulation of the bucket in the above-describe manner, substantial mechanical loads are transmitted to the mechanical linkage which connects the bucket to a frame of the work machine. This mechanical linkage includes a boom assembly and a stick which are pivotally coupled to each other. Accordingly, the boom assembly is subjected to substantial mechanical loads during operation of the work machine.

A boom assembly can include a boom body and a cylindrical boss which is welded to an end portion of the boom body. The substantial mechanical loads to which the boom assembly is subjected has the potential to cause deterioration of the weld which secures the cylindrical boss to the boom body. Such deterioration of the weld may undesirably reduce the useful life of the boom assembly.

What is needed therefore is a boom assembly which overcomes the above-mentioned drawback.

DISCLOSURE OF THE INVENTION

In accordance with a first embodiment of the present invention, there is provided a boom assembly of a work machine. The boom assembly includes a boom body having a top boom support structure, a bottom boom support structure, a first lateral boom support structure, and a second lateral boom support structure which cooperate with each other to define a boom void therein. The boom assembly also includes a coupling subassembly which is positioned within the boom void and attached to the boom body, wherein the coupling subassembly includes (i) a first coupling support structure and a second coupling support structure which are spaced apart from each other so as to define a boss space therebetween, and (ii) a boss positioned within the boss space and secured to the first coupling support structure and the second coupling support structure. In addition, (i) the boss has a pin passageway extending therethrough, (ii) the first coupling support structure has a first pin aperture defined therein, (iii) the second coupling support structure has a second pin aperture defined therein, and (iv) the pin passageway, the first pin aperture, and the second pin aperture are aligned with each other.

In accordance with a second embodiment of the present invention, there is provided a work machine which includes a boom body having a top boom support structure, a bottom boom support structure, a first lateral boom support structure, and a second lateral boom support structure which cooperate with each other to define a boom void therein. The boom body also has a machine frame coupling defined therein. The work machine also includes a coupling subassembly which is positioned within the boom void and attached to the boom body. The coupling subassembly includes (i) a first coupling support structure and a second coupling support structure which are spaced apart from each other so as to define a boss space therebetween and (ii) a boss positioned within the boss space and secured to the first coupling support structure and the second coupling support structure. In addition, (i) the boss has a pin passageway extending therethrough, (ii) the first coupling support structure has a first pin aperture defined therein, (iii) the second coupling support structure has a second pin aperture defined therein, and (iv) the pin passageway, the first pin aperture, and the second pin aperture are aligned with each other. The work machine further includes (i) a work machine stick which is pivotably coupled to the coupling subassembly and (ii) a work machine frame coupled to the machine frame coupling of the boom body.

BEST MODE FOR CARRYING OUT THE INVENTION

Figure 1:
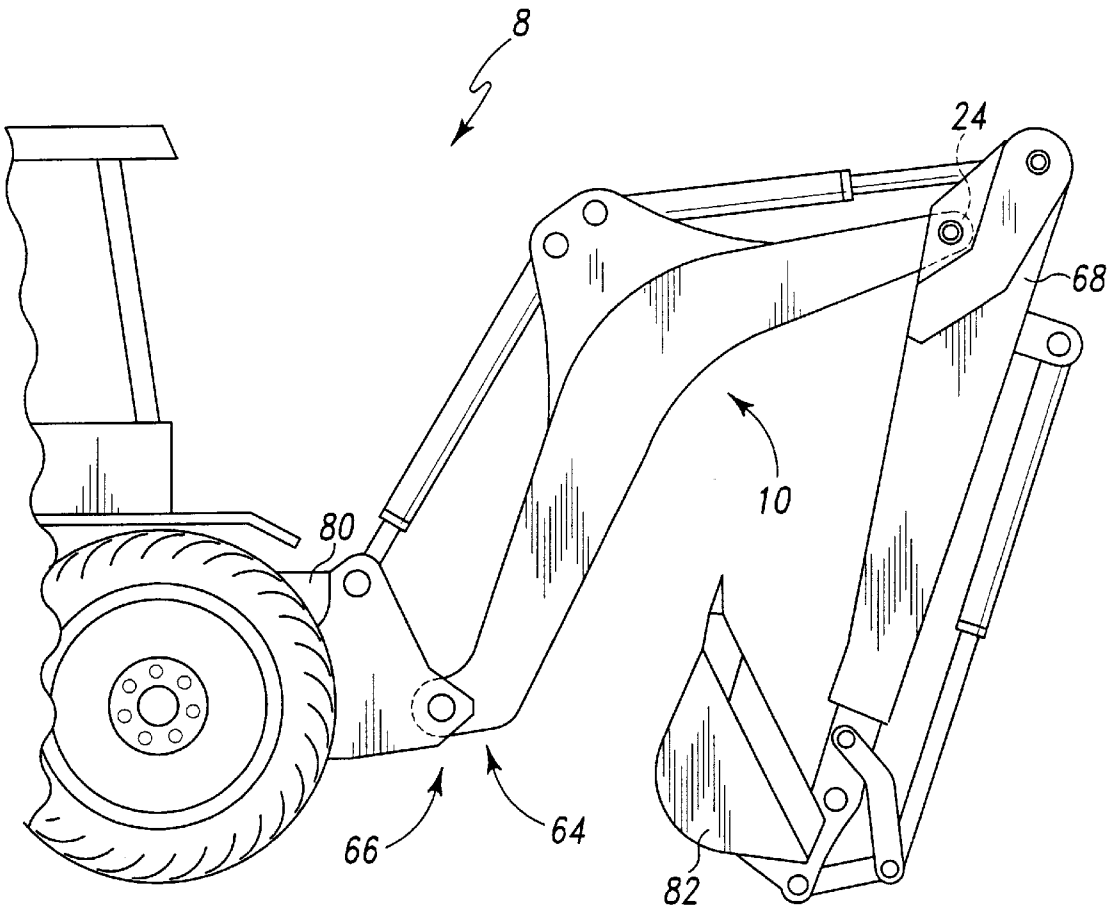
FIG. 1 is a fragmentary side elevational view of a work machine having a boom assembly which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a work machine 8 which incorporates the features of the present invention therein. Work machine 8 includes a work machine frame 80, a boom assembly 10, a work machine stick 68, and a bucket 82.

Figure 2:
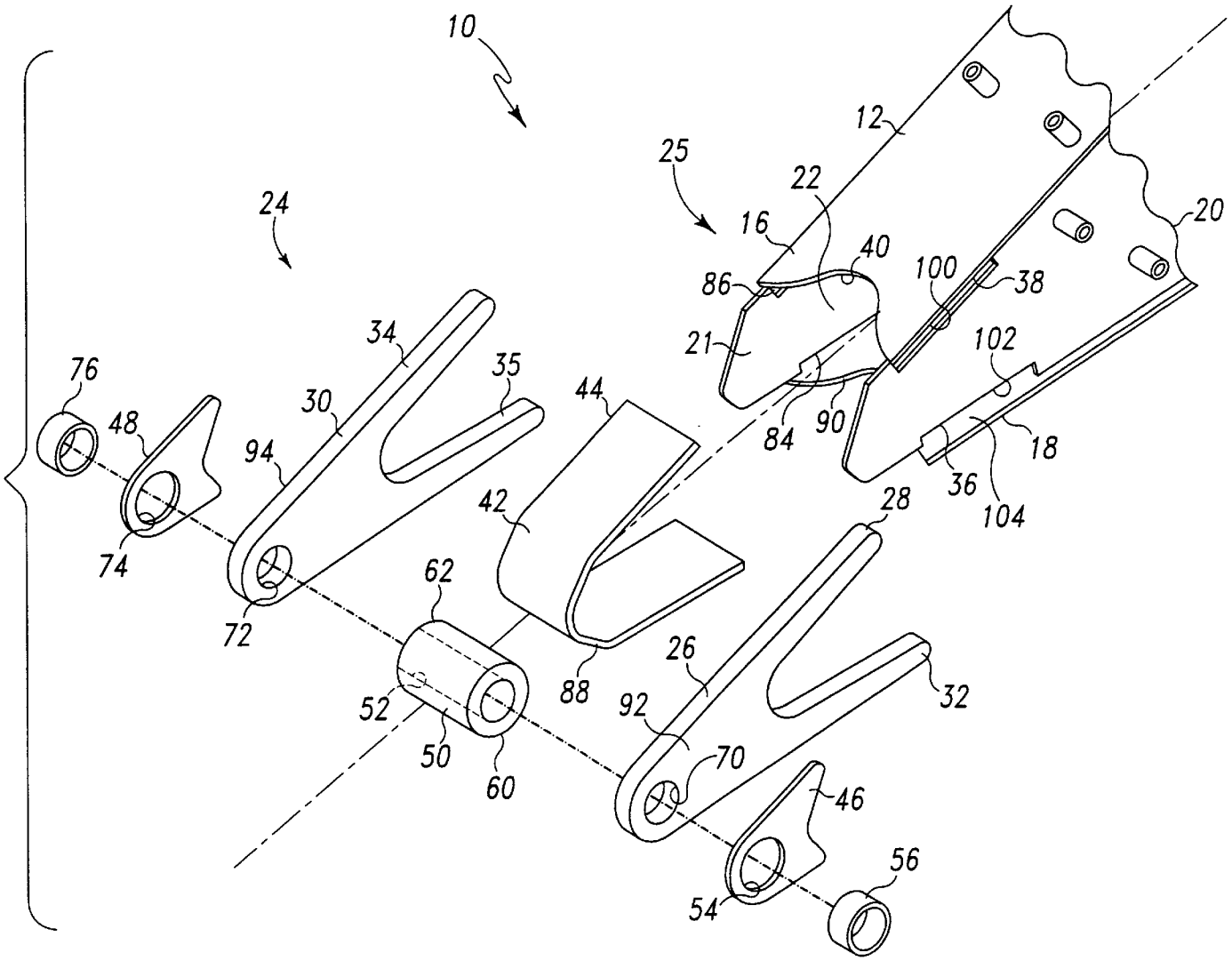
FIG. 2 is a fragmentary exploded perspective view of the boom assembly of FIG. 1.
Figure 4:
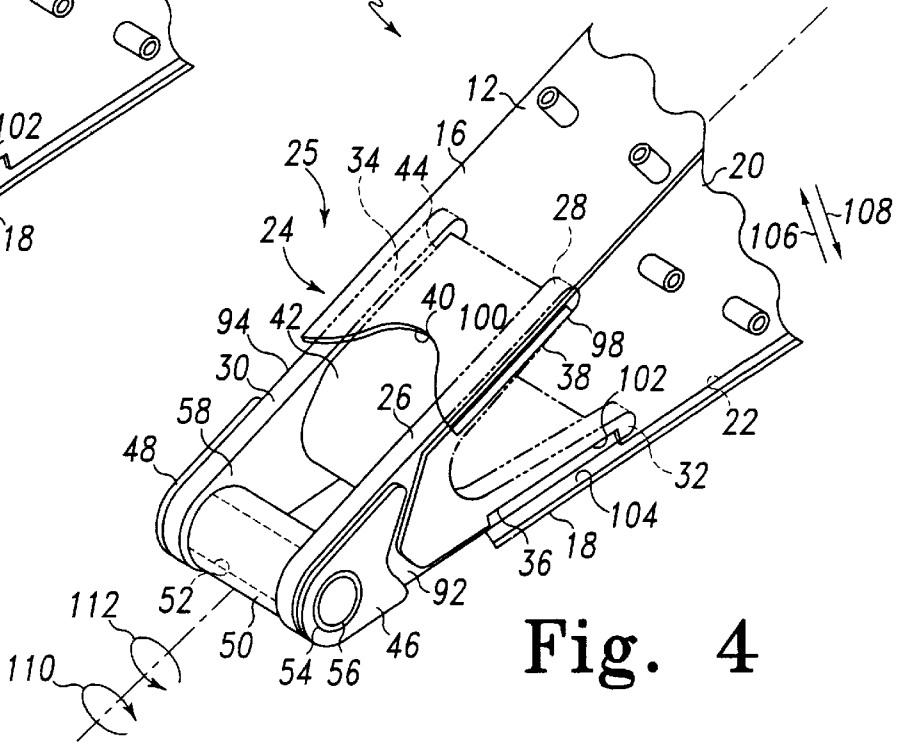
FIG. 4 is a view similar to FIG. 3, but showing the coupling subassembly positioned within the boom void of the boom body.
Figure 3:
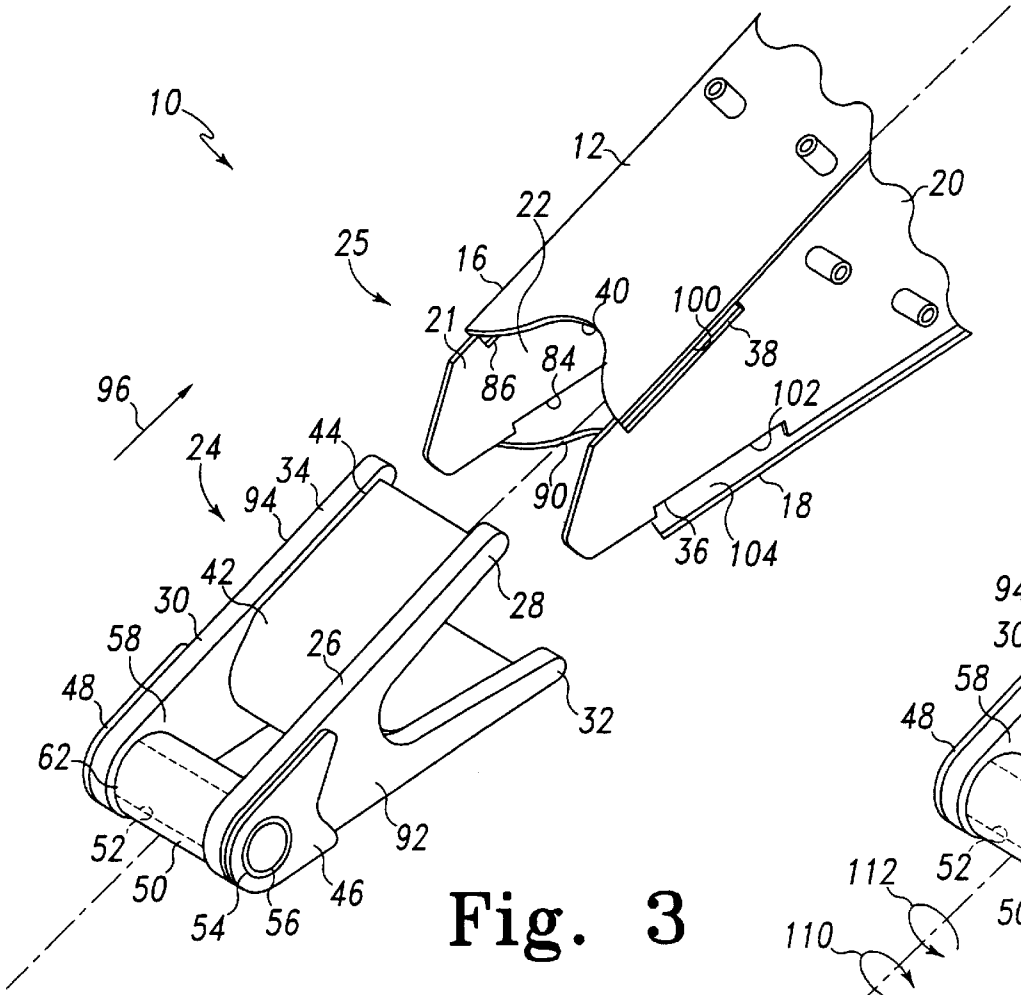
FIG. 3 is a perspective fragmentary view of the boom assembly of FIG. 1, showing the coupling subassembly spaced apart from the boom body for clarity of description.

Referring now to FIGS. 2, 3, and 4, boom assembly 10 includes a boom body 12 and a coupling subassembly 24. Boom body 12 has an end 25 and an end 64 (see FIG. 1). Boom body 12 also has a machine frame coupling 66 defined therein at end 64 (see FIG. 1). Boom body 12 further includes top boom support structure 16 having an end portion 40 which is concave and a bottom boom support structure 18 having an end portion 90 which is concave. Boom body 12 also includes a lateral boom support structure 20 having notches 36 and 38 formed therein and a lateral boom support structure 21 having notches 84 and 86 formed therein. It should be understood that top boom support structure 16, bottom boom support structure 18, lateral boom support structure 20, and lateral boom support structure 21 cooperate with each other to define a boom void 22 therein.

As shown in FIG. 2, coupling subassembly 24 includes a coupling support structure 26 having a pin aperture 70 defined therein. Coupling support structure 26 further has an upper leg 28 and a lower leg 32 extending therefrom.

Coupling subassembly 24 also includes a coupling support structure 30 having a pin aperture 72 defined therein. Coupling support structure 30 further has an upper leg 34 and a lower leg 35 extending therefrom. Coupling subassembly 24 further includes a boss 50 having an end 60, an end 62, and a pin passageway 52 extending therethrough. Coupling subassembly 24 also includes an auxiliary support member 46 having a hole 54 defined therein, and an auxiliary support member 48 having a hole 74 defined therein. Coupling subassembly 24 still further includes a bearing member 56, a bearing member 76, and a substantially U-shaped supplemental support plate 42. Supplemental support plate 42 includes an edge 44 and an edge 88.

As shown in FIGS. 3 and 4, coupling support structure 26 is spaced apart from coupling support structure 30 so as to define a boss space 58 therebetween. Boss 50 is positioned within boss space 58 such that end 60 (see FIG. 2) of boss 50 contacts, and is secured to (e.g. by welding) coupling support structure 26. Boss 50 is also positioned within boss space 58 so that end 62 of boss 50 contacts, and is secured to (e.g. by welding) coupling support structure 30. Boss 50 is further positioned within boss space 58 such that pin passageway 52 of boss 50 is aligned with pin aperture 70 (see FIG. 2) of coupling support structure 26 and pin aperture 72 of coupling support structure 30.

Substantially U-shaped supplemental support plate 42 is also positioned within boss space 58 such that edge 88 (see FIG. 2) of substantially U-shaped supplemental support plate 42 contacts upper leg 28 and lower leg 32 of coupling support structure 26. Edge 88 of substantially U-shaped supplemental support plate 42 is then welded to upper leg 28 and lower leg 32 of coupling support structure 26. Substantially U-shaped supplemental support plate 42 is also positioned within boss space 58 such that edge 44 of substantially U-shaped supplemental support plate 42 contacts upper leg 34 and lower leg 35 (see FIG. 2) of coupling support structure 30. Edge 44 of substantially U-shaped supplemental support plate 42 is then welded to upper leg 34 and lower leg 35 of coupling support structure 30.

Auxiliary support member 46 is positioned in contact with an outside surface 92 of coupling support structure 26 such that hole 54 of auxiliary support member 46 is aligned with pin aperture 70 and pin passageway 52. Auxiliary support member 46 is then welded to outside surface 92 of coupling support structure 26. In a similar manner, auxiliary support member 48 is positioned in contact with an outside surface 94 of coupling support structure 30 such that hole 74 of auxiliary support member 48 is aligned with pin aperture 72 and pin passageway 52. Auxiliary support member 48 is then welded to outside surface 94 of coupling support structure 30.

Bearing member 56 is press fit into hole 54 and pin aperture 70 (see FIG. 2) so as to be aligned with pin passageway 52. In a similar manner, bearing member 76 (see FIG. 2) is press fit into hole 74 and pin aperture 72 so as to be aligned with pin passageway 52.

Once constructed in the above described manner, coupling subassembly 24 is positioned relative to boom body 12 as shown in FIG. 3. Coupling subassembly 24 is then moved toward boom body 12 in the direction indicated by arrow 96 until upper leg 28, upper leg 34, lower leg 32, and lower leg 35 (see FIG. 2) are positioned within boom void 22 as shown in FIG. 4. In addition, coupling subassembly 24 is positioned within boom void 22 such that (i) upper leg 28 contacts top boom support structure 16 and lateral boom support structure 20, (ii) lower leg 32 contacts bottom boom support structure 18 and lateral boom support structure 20, (iii) upper leg 34 contacts top boom support structure 16 and lateral boom support structure 21 (see FIG. 2), (iv) lower leg 35 contacts lateral boom support structure 21 and bottom boom support structure 18, and (v) end portion 40 of top boom support structure 16 and end portion 90 (see FIG. 2) of bottom boom support structure 18 contact substantially U-shaped supplemental support plate 42.

After positioning coupling subassembly 24 in boom void 22 in the aforementioned manner, upper leg 28 is welded to lateral boom support structure 20 along an edge 98 of notch 38 so as to secure upper leg 28 to lateral boom support structure 20. Upper leg 28 is also welded to top boom support structure 16 along a portion 100 of top boom support structure 16 which is adjacent to notch 38 so as to secure upper leg 28 to top boom support structure 16. In addition, lower leg 32 is welded to lateral boom support structure 20 along an edge 102 of notch 36 so as to secure lower leg 32 to lateral boom support structure 20. Lower leg 32 is also welded to bottom boom support structure 18 along a portion 104 of bottom boom support structure 18 which is adjacent to notch 36 so as to secure lower leg 32 to bottom boom support structure 18.

Upper leg 34 is welded to top boom support structure 16 and lateral boom support structure 21 in a manner similar to that described for upper leg 28 so as to secure upper leg 34 to top boom support structure 16 and lateral boom support structure 21. Specifically, upper leg 34 is welded to lateral boom support structure 21 along an edge of notch 86. In addition, upper leg is welded to top boom support structure 16 along a portion of top boom support structure 16 which is adjacent to notch 86. Lower leg 35 is welded to bottom boom support structure 18 and lateral boom support structure 21 in a manner similar to that described for lower leg 32 so as to secure lower leg 35 to bottom boom support structure 18 and lateral boom support structure 21. Specifically, lower leg 35 is welded to lateral boom support structure 21 along an edge of notch 84. In addition, lower leg 35 is welded to bottom boom support structure 18 along a portion of bottom boom support structure 18 which is adjacent to notch 84.

End portion 40 of top boom support structure 16 is welded to coupling support structure 26, substantially U-shaped supplemental support plate 42, and coupling support structure 30. Moreover, end portion 90 (see FIGS. 2 and 3) of bottom boom support structure 18 is welded to coupling support structure 26, substantially U-shaped supplemental support plate 42, and coupling support structure 30.

It should be understood that securing upper leg 28, upper leg 34, lower leg 32, and lower leg 35 in the above described manner attaches coupling subassembly 24 to end 25 of boom body 12 such that coupling support structure 26 is secured to lateral boom support structure 20, top boom support structure 16 and bottom boom support structure 18. In addition, coupling support structure 30 is attached to lateral boom support structure 21, top boom support structure 16, and bottom boom support structure 18. Furthermore, boss 50 is spaced apart from top boom support structure 16, bottom boom support structure 18, lateral boom support structure 20, and lateral boom support structure 21 of boom body 12.

Industrial Applicability

During use of boom assembly 10, end 64 thereof is pivotally coupled to work machine frame 80 via machine frame coupling 66, and coupling subassembly 24 is pivotally coupled to work machine stick 68 as shown in FIG. 1. In addition, bucket 82 is pivotally coupled to an end of work machine stick 68 (see FIG. 1). The above described arrangement allows an operator of work machine 8 to manipulate boom assembly 10, work machine stick 68, and bucket 82 so as to perform a work function, such as digging a hole or moving large amounts of gravel.

During the performance of a work function, significant mechanical loads are transmitted to boom assembly 10 (including coupling subassembly 24) and work machine stick 68. Heretofore, boom assembly designs included welds between the boss and the boom body which would deteriorate in a relatively short period of time as a result of being subjected to these mechanical loads. The deterioration of these welds may undesirably reduce the useful life of the boom assembly. As a result, the boom assembly would have to be replaced or expensive and time consuming repairs would have to be performed before proceeding with additional work functions.

The present invention addresses the aforementioned problems. Specifically, various design features of coupling subassembly 24 of the present invention are able to accommodate these mechanical loads with less deterioration of the welds and other components of boom assembly 10. For example, upper leg 28 and lower leg 32 of coupling subassembly 24 are capable of slightly moving or flexing relative to each other in the directions indicated by arrows 106 and 108 (see FIG. 4). Upper leg 34 and lower leg 35 are also able to flex relative to each other in an identical manner. In addition, substantially U-shaped supplemental support plate 42 inhibits the mechanical loads transmitted to coupling subassembly 24 from twisting coupling subassembly 24 relative to boom body 12 in the directions indicated by arrows 110 and 112 (see FIG. 4). Moreover, coupling subassembly 24 utilizes a greater number of components and a greater amount of weld to attach boss 50 to boom body 12 as compared to the arrangement where a boss is attached directly to a boom body. Having a greater number of components and a greater amount of weld helps to spread out or share the transmitted loads between the components and welds of coupling subassembly 24. Spreading out or sharing these mechanical loads prevents any one component or weld from being over burdened. Furthermore, the shape of some of the components of boom assembly 10 enhances the strength of the weld seams therebetween. For example, welding top boom support structure 16 to coupling support structure 26, substantially U-shaped supplemental support plate 42, and coupling support structure 30 along an end portion 40 which is concave as shown in FIGS. 3 and 4 increases the weld length as compared to the situation where the end portion of top boom support structure 16 defines a straight line. Specifically, welding along concave end portion 40 as shown in FIGS. 3 and 4 results in a weld about 14 inches in length as compared to about 10 inches if the end portion of top boom support structure 16 defined a substantially straight line. Having a greater weld length increases the strength of the weld. The same holds true for welding bottom boom support structure 18 to coupling support structure 26, substantially U-shaped supplemental support plate 42, and coupling support structure 30 along concave end portion 90.

All of the above described design features are important aspects of the present invention since they enhance the capacity of boom assembly 10 to accommodate the mechanical loads transmitted thereto. As a result, the welds and components included in boom assembly 10 have a relatively reduced deterioration rate as compared to other boom assembly designs. Therefore, boom assembly 10 has a relatively long useful life as compared to the other boom assembly designs.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A boom assembly of a work machine, comprising:

a boom body having a top boom support structure, a bottom boom support structure, a first lateral boom support structure, and a second lateral boom support structure which cooperate with each other to define a boom void therein; and a coupling subassembly which is positioned within said boom void and attached to said boom body, wherein said coupling subassembly includes (i) a first coupling support structure and a second coupling support structure which are spaced apart from each other so as to define a boss space therebetween, and (ii) a boss positioned within said boss space and secured to said first coupling support structure and said second coupling support structure, wherein (i) said boss has a pin passageway extending therethrough, (ii) said first coupling support structure has a first pin aperture defined therein, (iii) said second coupling support structure has a second pin aperture defined therein, and (iv) said pin passageway, said first pin aperture, and said second pin aperture are aligned with each other, wherein said first coupling support structure has a first upper leg and a first lower leg extending therefrom, said second coupling support structure has a second upper leg and a second lower leg extending therefrom, said first upper leg and said first lower leg each being (i) positioned within said boom void, and (ii) secured to said boom body, said second upper leg and said second lower leg each being (i) positioned within said boom void, and (ii) secured to said boom body, said first coupling support structure is secured to said first lateral boom support structure, said top boom support structure, and said bottom boom support structure, and said second coupling support structure is secured to said second lateral boom support structure, said top boom support structure, and said bottom boom support structure.

2. A boom assembly of a work machine, comprising:

a boom body having a top boom support structure, a bottom boom support structure, a first lateral boom support structure, and a second lateral boom support structure which cooperate with each other to define a boom void therein; and a coupling subassembly which is positioned within said boom void and attached to said boom body, wherein said coupling subassembly includes (i) a first coupling support structure and a second coupling support structure which are spaced apart from each other so as to define a boss space therebetween, and (ii) a boss positioned within said boss space and secured to said first coupling support structure and said second coupling support structure, wherein (i) said boss has a pin passageway extending therethrough, (ii) said first coupling support structure has a first pin aperture defined therein, (iii) said second coupling support structure has a second pin aperture defined therein, and (iv) said pin passageway, said first pin aperture, and said second pin aperture are aligned with each other, wherein said first coupling support structure has a first upper leg and a first lower leg extending therefrom, said second coupling support structure has a second upper leg and a second lower leg extending therefrom, said first upper leg and said first lower leg each being (i) positioned within said boom void, and (ii) secured to said boom body, and said second upper leg and said second lower leg each being (i) positioned within said boom void, and (ii) secured to said boom body, wherein said coupling subassembly further includes a substantially U-shaped supplemental support plate positioned within said boss space, and said substantially U-shaped supplemental support plate is secured to said first upper leg, said first lower leg, said second upper leg, and said second lower leg.

3. A boom assembly of a work machine, comprising:

a boom body having a top boom support structure, a bottom boom support structure, a first lateral boom support structure, and a second lateral boom support structure which cooperate with each other to define a boom void therein; and a coupling subassembly which is positioned within said boom void and attached to said boom body, wherein said coupling subassembly includes (i) a first coupling support structure and a second coupling support structure which are spaced apart from each other so as to define a boss space therebetween, and (ii) a boss positioned within said boss space and secured to said first coupling support structure and said second coupling support structure, wherein (i) said boss has a pin passageway extending therethrough, (ii) said first coupling support structure has a first pin aperture defined therein, (iii) said second coupling support structure has a second pin aperture defined therein, and (iv) said pin passageway, said first pin aperture, and said second pin aperture are aligned with each other, wherein said coupling subassembly further includes a first auxiliary support member having a first hole defined therein, said first auxiliary support member being secured to said first coupling support structure so that said first hole is aligned with said first pin aperture, and a second auxiliary support member having a second hole defined therein, said second auxiliary support member being secured to said second coupling support structure so that said second hole is aligned with said second pin aperture, wherein said coupling subassembly further includes a first bearing member positioned with said first hole of said first auxiliary support member, and a second bearing member positioned with said second hole of said second auxiliary support member.

4. A boom assembly of a work machine, comprising:

a boom body having a top boom support structure, a bottom boom support structure, a first lateral boom support structure, and a second lateral boom support structure which cooperate with each other to define a boom void therein; and a coupling subassembly which is positioned within said boom void and attached to said boom body, wherein said coupling subassembly includes (i) a first coupling support structure and a second coupling support structure which are spaced apart from each other so as to define a boss space therebetween, and (ii) a boss positioned within said boss space and secured to said first coupling support structure and said second coupling support structure, wherein (i) said boss has a pin passageway extending therethrough, (ii) said first coupling support structure has a first pin aperture defined therein, (iii) said second coupling support structure has a second pin aperture defined therein, and (iv) said pin passageway, said first pin aperture, and said second pin aperture are aligned with each other, wherein said top boom support structure and said bottom support structure each has an end portion which (i) is concave, and (ii) is attached to said coupling subassembly.

5. A work machine, comprising:

a boom body having a top boom support structure, a bottom boom support structure, a first lateral boom support structure, and a second lateral boom support structure which cooperate with each other to define a boom void therein, wherein said boom body has a machine frame coupling defined therein;

a coupling subassembly which is positioned within said boom void and attached to said boom body, wherein said coupling subassembly includes (i) a first coupling support structure and a second coupling support structure which are spaced apart from each other so as to define a boss space therebetween, and (ii) a boss positioned within said boss space and secured to said first coupling support structure and said second coupling support structure, and further wherein (i) said boss has a pin passageway extending therethrough, (ii) said first coupling support structure has a first pin aperture defined therein, (iii) said second coupling support structure has a second pin aperture defined therein, and (iv) said pin passageway, said first pin aperture, and said second pin aperture are aligned with each other:

a work machine stick which is pivotably coupled to said coupling subassembly; and a work machine frame coupled to said machine frame coupling of said boom body, wherein said first coupling support structure has a first upper leg and a first lower leg extending therefrom, said second coupling support structure has a second upper leg and a second lower leg extending therefrom, said first upper leg and said first lower leg each being (i) positioned within said boom void, and (ii) secured to said boom body, and said second upper leg and said second lower leg each being (i) positioned within said boom void, and (ii) secured to said boom body, wherein said coupling subassembly further includes a substantially U-shaped supplemental support plate positioned within said boss space, and said substantially U-shaped supplemental support plate is secured to said first upper leg, said first lower leg, said second upper leg, and said second lower leg.

6. A work machine, comprising:

a boom body having a top boom support structure, a bottom boom support structure, a first lateral boom support structure, and a second lateral boom support structure which cooperate with each other to define a boom void therein, wherein said boom body has a machine frame coupling defined therein;

a coupling subassembly which is positioned within said boom void and attached to said boom body, wherein said coupling subassembly includes (i) a first coupling support structure and a second coupling support structure which are spaced apart from each other so as to define a boss space therebetween, and (ii) a boss positioned within said boss space and secured to said first coupling support structure and said second coupling support structure, and further wherein (i) said boss has a pin passageway extending therethrough, (ii) said first coupling support structure has a first pin aperture defined therein, (iii) said second coupling support structure has a second pin aperture defined therein, and (iv) said pin passageway, said first pin aperture, and said second pin aperture are aligned with each other;

a work machine stick which is pivotably coupled to said coupling subassembly; and a work machine frame coupled to said machine frame coupling of said boom body, wherein said top boom support structure and said bottom support structure each has an end portion which (i) is concave, and (ii) is attached to said coupling subassembly.

* * * * *